US009168540B2

(12) United States Patent
Zhou et al.

(10) Patent No.: US 9,168,540 B2
(45) Date of Patent: Oct. 27, 2015

(54) OUTLET MECHANISM WITH PULSATILE SPLASH

(75) Inventors: Huasong Zhou, Xiamen (CN); Li Jiang, Xiamen (CN); Yurong Yang, Xiamen (CN); Xianguo Zou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 93 days.

(21) Appl. No.: 13/990,607

(22) PCT Filed: Nov. 29, 2011

(86) PCT No.: PCT/CN2011/083098

§ 371 (c)(1),
(2), (4) Date: May 30, 2013

(87) PCT Pub. No.: WO2012/072018

PCT Pub. Date: Jun. 7, 2012

(65) Prior Publication Data

US 2013/0240644 A1 Sep. 19, 2013

(30) Foreign Application Priority Data

Dec. 2, 2010 (CN) ..... 2010 1 0570813

(51) Int. Cl.
*B05B 1/08* (2006.01)

(52) U.S. Cl.
CPC ..... *B05B 1/08* (2013.01)

(58) Field of Classification Search
CPC ..... B05B 1/08
USPC ..... 239/436, 439, 456, 589.1
See application file for complete search history.

(56) References Cited

U.S. PATENT DOCUMENTS

| | | | | | |
|---|---|---|---|---|---|
| 3,468,326 | A | * | 9/1969 | Cohen | 137/809 |
| 3,563,462 | A | | 2/1971 | Bauer | |
| 4,550,614 | A | * | 11/1985 | Herzl | 73/861.19 |
| 4,955,547 | A | * | 9/1990 | Woods | 239/589.1 |
| 4,976,155 | A | * | 12/1990 | Challandes | 73/861.19 |
| RE33,605 | E | * | 6/1991 | Bauer | 239/589.1 |
| 5,860,603 | A | * | 1/1999 | Raghu et al. | 239/589.1 |
| 6,497,375 | B1 | * | 12/2002 | Srinath et al. | 239/589.1 |

(Continued)

FOREIGN PATENT DOCUMENTS

| | | | |
|---|---|---|---|
| CN | 201482611 | U | 5/2010 |
| CN | 102059178 | A | 5/2011 |

(Continued)

*Primary Examiner* — Ryan Reis
(74) *Attorney, Agent, or Firm* — Rabin & Berdo, P.C.

(57) ABSTRACT

An outlet mechanism with pulsatile splash has a main waterway comprising an inlet waterway, two branch waterways and two back-flow waterways; the two branch waterways communicate with the outlet end of the inlet waterway and are arranged symmetrically with respect to the inlet waterway. The outlet directions of the outlet ends of the two branch waterways intersect; the two back-flow waterways are arranged symmetrically with respect to the inlet waterway, and one end of the back-flow waterway communicates with the branch waterway. Another end of that communicates with the inlet end of the inlet waterway. Part of water in the branch waterway is returned to the inlet end of the inlet waterway by the back-flow waterway. The remain water in the two branch waterways intersect when water comes out of the outlet, so that the left-and-right-swing outlet effect, and then the pulsatile splash outlet effect are generated.

12 Claims, 3 Drawing Sheets

(56) References Cited

U.S. PATENT DOCUMENTS

| | | | | |
|---|---|---|---|---|
| 2005/0214147 | A1 | 9/2005 | Schultz et al. | |
| 2011/0049271 | A1 * | 3/2011 | Cheng | 239/540 |

FOREIGN PATENT DOCUMENTS

| | | | |
|---|---|---|---|
| EP | 1472966 | A2 | 11/2004 |
| GB | 1307712 | A | 2/1973 |

* cited by examiner

OUTLET MECHANISM WITH PULSATILE SPLASH

FIELD OF THE INVENTION

The present invention relates to an outlet mechanism with pulsatile splash.

BACKGROUND OF THE INVENTION

The outlet mechanism with pulsatile splash at the prior art, comprises an outlet body and a movement assembly that is arranged in the outlet body in a moving manner, the left-and-right-swing outlet effect is generated from the outlet body through the relative movement of the movement assembly to the outlet body, and then the pulsatile splash outlet effect is generated. Because the mechanism achieves the outlet effect through the coupling of the outlet body and the movement assembly, a plurality of defects are present: 1 the structure is complicated with high space occupation, a lot of materials, high accuracy demanding and high manufacturing cost; 2 the movement part is easy to be abraded, and the outlet is unstable.

SUMMARY OF THE INVENTION

The object of the present invention is to offer an outlet mechanism with pulsatile splash which overcomes the defects of the mechanism with pulsatile splash at the prior art.

The technical proposal solving the technical matter in the present invention is:

An outlet mechanism with pulsatile splash, in which a main waterway is arranged, the main waterway comprises an inlet waterway (100), two branch waterways (200) and two back-flow waterways (300); the two branch waterways (200) are communicated with the outlet end of the inlet waterway (100) and arranged symmetrically with respect to the inlet waterway (100), the outlet directions of the outlet ends of the two branch waterways (200) are intersecting; the two back-flow waterways (300) are arranged symmetrically with respect to the inlet waterway (100), and one end of the back-flow waterways (300) is communicated with the branch waterway (200), another end of that is communicated with the inlet end of the inlet waterway (100).

In a preferred embodiment, two vortex cavities (400) are arranged at the left side and the right side of the inlet waterway (100) to enhance the flowing ability of fluid.

In a preferred embodiment, the two side walls of the inlet waterway (100) are arranged to be inclined planes, and the included angle is 10 to 40 degree.

In a preferred embodiment, one end of the branch waterway (200) with respect to the back-flow waterway (300) is divided into a first waterway (210) and a second waterway (220), and the first waterway (210) is designed to be a pliable waterway; the first waterways (210) of the two branch waterways (200) are connected to the left and the right sides of the outlet end of the inlet waterway (100), and the first waterways (210) transit to the inlet waterway (200) smoothly.

In a preferred embodiment, the vortex cavities (400) are arranged at the inlet waterway (100) and near the outlet end.

In a preferred embodiment, the vortex cavities (400) are arranged in grooves at the side of the inlet waterway (100) in a concaving manner, and the grooves are arranged to be globular, of which the openings are smaller than the globular diameter.

In a preferred embodiment, the outlet end of the inlet waterway (100) between the two branch waterways (200) is designed to be an arc groove (110).

In a preferred embodiment, the outlet area of the first waterways (210) is turned bigger gradually, and one end of the back-flow waterway (300) transit to the first waterways (210) smoothly.

In a preferred embodiment, the extended lines of the outlet ends of the two branch waterways are intersected to form a catchment segment (500), and an arc slot (510) is arranged to the top end of the catchment segment (500).

In a preferred embodiment, it also comprises a body (A) and an attaching wall (B); an inlet hole (A1) and a concave cavity (A2) are arranged at the body (A); and a water channel (B1) coupling with the main waterway is arranged at the side of the attaching wall (B); the attaching wall (B) is mounted in the concave cavity (A2) of the body (A), and the side of the attaching wall (B) is relying on the side of the concave cavity (A2) hermetically, so that the main waterway is generated in the water channel (B1), and then the inlet waterway (100) is communicated with the inlet hole (A1).

In a preferred embodiment, it also comprises an outlet nozzle (C), the outlet nozzle (C) is mounted to the concave cavity (A2) of the body (A) in a coupling manner, and outlet holes (C1) of the outlet nozzle (C) is communicated with the outlet end of the two branch waterways (200).

Compared with the technical proposal at the prior art, the benefits of the present invention are:

1 the two branch waterways are connected to the inlet waterway, part of water in the branch waterway is returned to the inlet end of the inlet waterway by the back-flow waterway to impact the water flow in the inlet waterway, the remain part of water in the two branch waterways intersects when water comes out of the outlet, so that the left-and-right-swing outlet effect is generated, and then the pulsatile splash outlet effect is generated, and the defects of the prior art are overcome, and the following effects are present: a, no movement assembly, so that the structure is simple, and the manufacturing cost is low; b, no attrition, so that the service life is long and the outlet frequency is stable; c, the water-saving effect and shower effect are good;

2 when water flows into the outlet waterway from the inlet waterway, vortex is generated in the vortex cavities to enhance the flow ability of fluid, and then water is absorbed into the branch waterways from the inlet end of the inlet waterways;

3 the outlet area of the inlet waterway is turned bigger gradually with enhanced fluid flow ability, better left-and-right-swing effect, and better pulsatile splash outlet effect;

4 the first waterway is designed to be pliable waterway, and the first waterway transit to the inlet waterway smoothly with enhanced left-and-right-swing effect and better pulsatile splash outlet effect;

5 the body and the attaching wall are fixed to form the main waterway with simple processing and low manufacturing cost.

BRIEF DESCRIPTION OF THE DRAWINGS

With the following description of the drawings and specific embodiments, the invention shall be further described in details.

DESCRIPTION OF THE PREFERRED EMBODIMENTS

Figure 1:
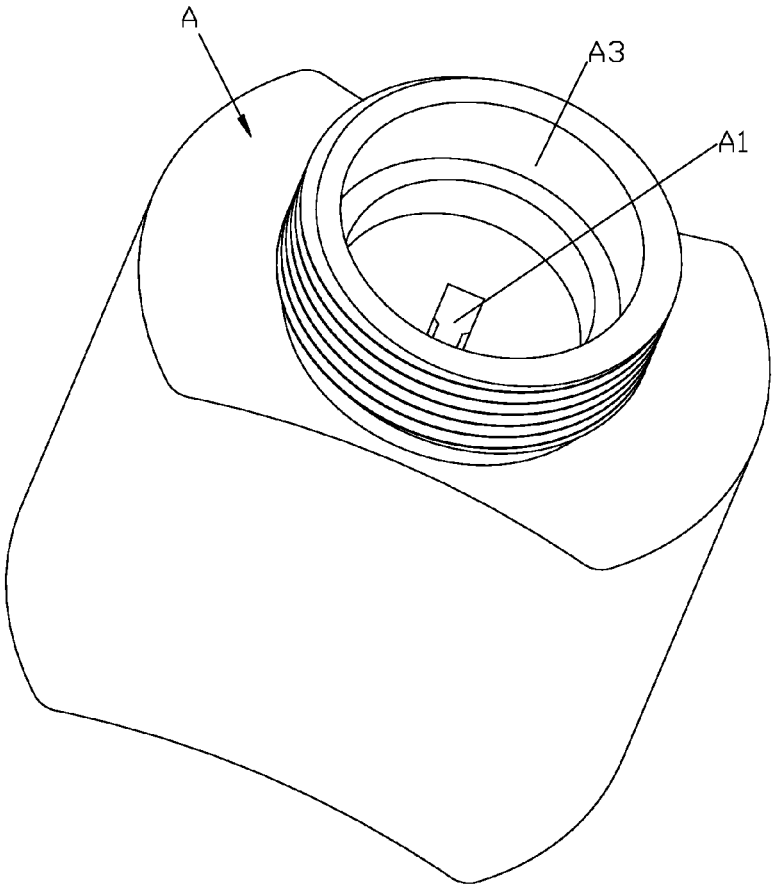
FIG. 1 shows the solid abridged general view of the mechanism in a preferred embodiment.
Figure 2:
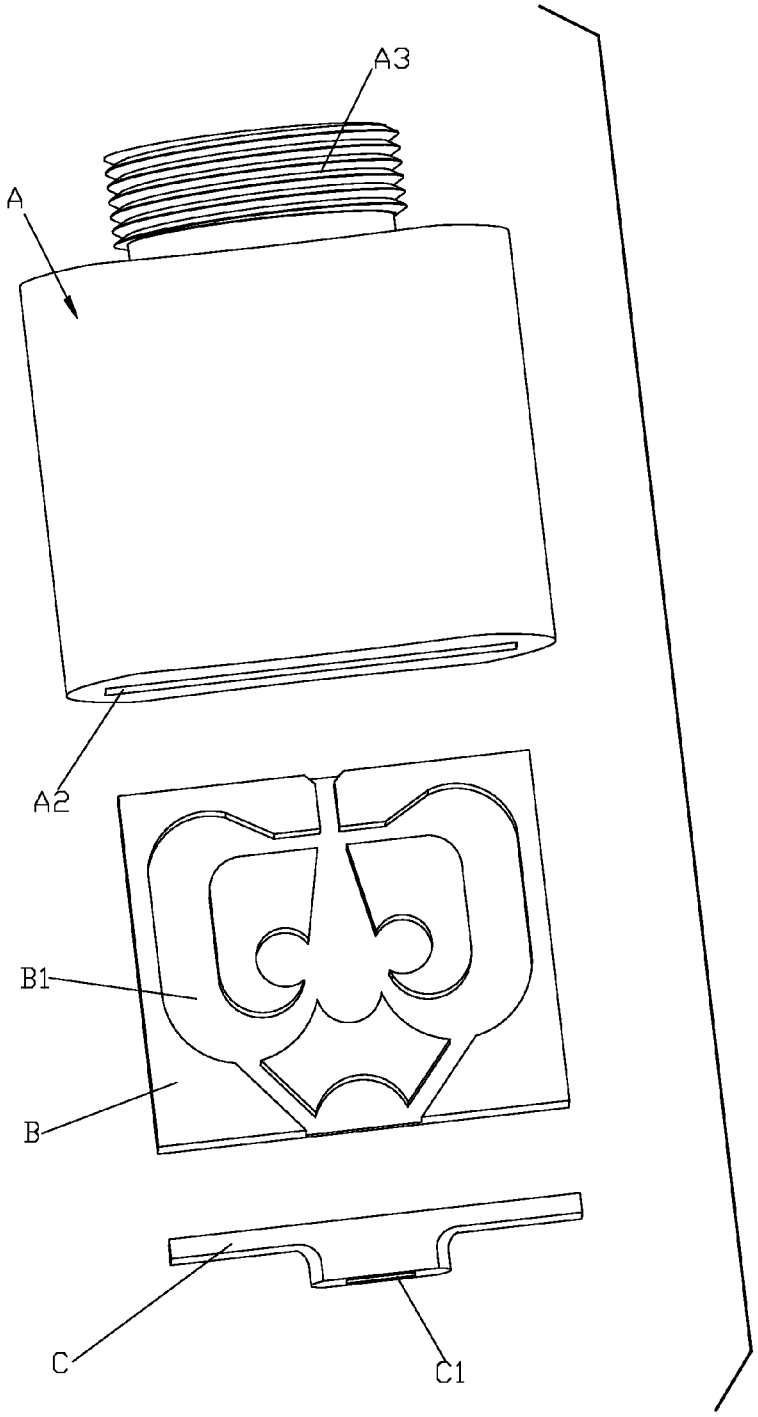
FIG. 2 shows the solid structural view of the mechanism in a preferred embodiment.
Figure 3:
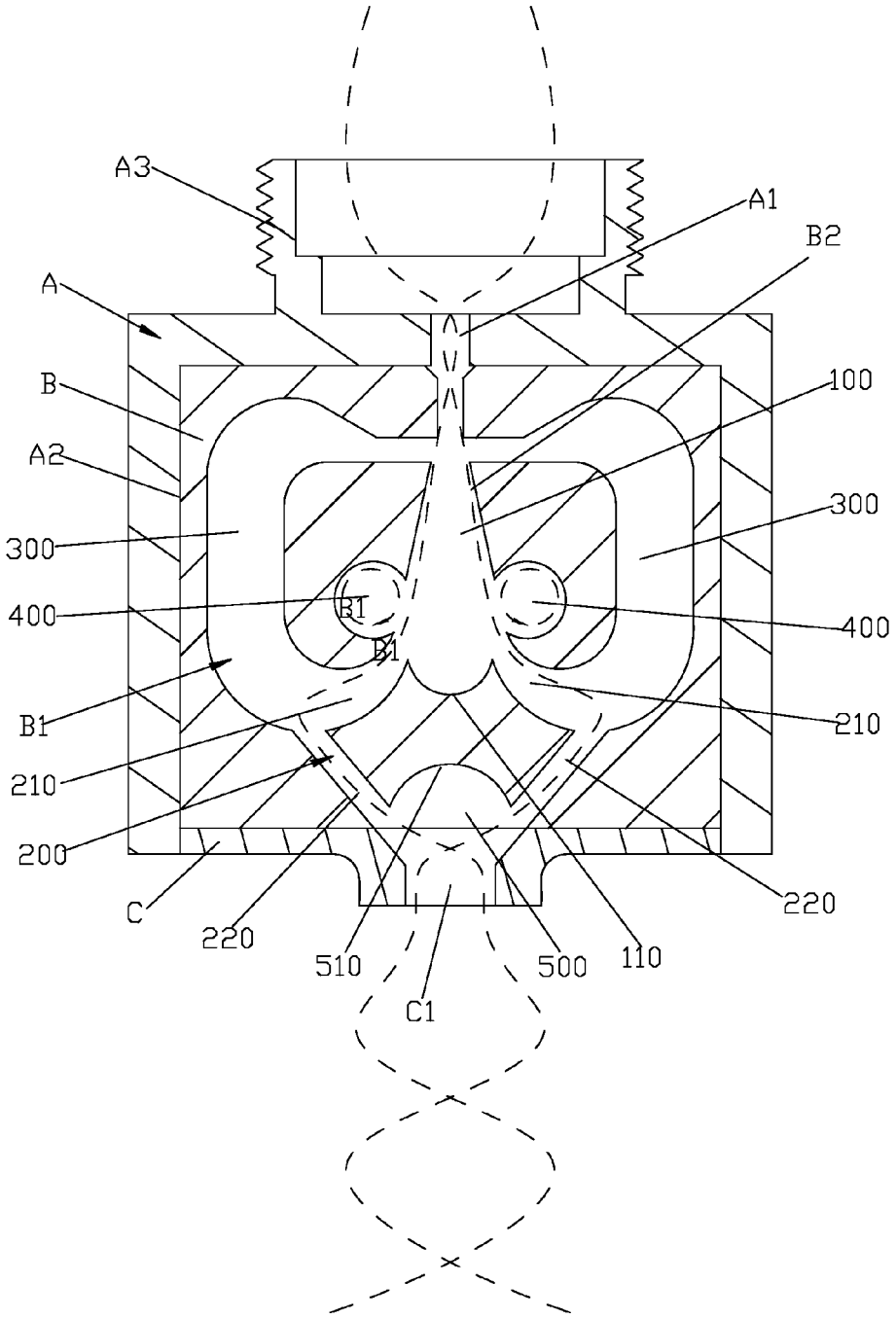
FIG. 3 shows the sectional view of the mechanism in a preferred embodiment.

According to FIGS. 1, 2 and 3, an outlet mechanism with pulsatile splash comprises a body A, an attaching wall B and an outlet nozzle C. The body A and the attaching wall B are coupling with each other to form a main waterway.

The main waterway comprises an inlet waterway 100, two branch waterways 200 and two back-flow waterways 300; the two branch waterways 200 are communicating with the inlet waterway 100 and arranged symmetrically with respect to the inlet waterway 100, and the outlet directions of the outlet ends of the two branch waterways 200 are intersecting; the two back-flow waterways 300 are arranged symmetrically with respect to the inlet waterway 100, and one end of the back-flow waterway 300 is communicated with the branch waterway 200, another end of that is communicated with the inlet end of the inlet waterway 100.

In the present embodiment, the left side and the right side of the inlet waterway 100 are arranged to be inclined planes symmetrically, and the included angle B2 is 10 to 40 degree, so that the outlet area is turned larger gradually.

In the present embodiment, the outlet end of the inlet waterway 100 is designed to be an arc groove 110 between the two branch waterways to enhance the eddy-generating ability of the vortex cavity 400.

In the present embodiment, two vortex cavities 400 are arranged at the left side and the right side of the inlet waterway 100 to enhance the flowing ability of fluid. And the vortex cavities 400 are arranged to the inlet waterway 100 and near the outlet end, such as at the end of the inclined plane of the two sides of the inlet waterway 100. The vortex cavities 400 are arranged in the groove at the side of the inlet waterway 100 in a concaving manner, and the groove is arranged to be globular, of which the opening is smaller than the globular diameter.

The one end of the branch waterway 200 with respect to the back-flow water way 300 is divided into the first waterway 210 and the second waterway 220, and the first waterway 210 is designed to be a pliable waterway. The first waterways 210 of the two branch waterways 200 are connected to the left and the right sides of the outlet end of the inlet waterway 100, and the first waterway 210 is transit to the inlet waterway 200 smoothly. The second waterway 220 is designed to be a straight waterway, so that the outlet directions of the outlet ends of the two branch waterways 200 are intersected.

It is better that it also comprises a catchment segment 500, the extended lines of the outlet ends of the two branch waterways are intersected at the catchment segment 500. And it is better that an arc slot 510 is arranged to the top end of the catchment segment 500.

In the present embodiment, the outlet area of the first waterway 210 is turned bigger gradually, and one end of the back-flow waterway 300 is transit to the first waterway 210 smoothly.

An inlet hole A1 and a concave cavity A2 are arranged to the body A; a connector A3 with external thread at its outer surrounding surface for easy connecting is also arranged, communicating with the inlet hole; the inlet hole A1 is communicated with the concave cavity A2. The side of the attaching wall B is coupling with the water channel B1 of the main waterway; the attaching wall B is mounted in the concave cavity A2 of the body A, and the side of the attaching wall B is relying on the side of the concave cavity A2 hermetically, so that the main waterway is generated in the water channel B1, and then the main waterway is communicated with the inlet hole A1, and then the inlet waterway 100 is communicated with the inlet hole A1. The outlet nozzle C is mounted to the concave cavity A2 of the body A in a coupling manner, and the outlet nozzle C is provided with a outlet hole C1 that is communicated with the catchment segment 500.

The present outlet mechanism with pulsatile splash can be used in the bathroom field, and can offer different outlet patterns.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

An outlet mechanism with pulsatile splash is present in the present invention, its main waterway comprises a inlet waterway, two branch waterways and two back-flow waterways; part of water in the branch waterway is returned to the inlet end of the inlet waterway by the back-flow waterway to impact the water flow in the inlet waterway, the remain part of water in the two branch waterways are intersects when water comes out of the outlet, so that the left-and-right-swing outlet effect is generated, and then the pulsatile splash outlet effect is generated with simple structure, low manufacturing cost, no attrition, long service life and stable outlet frequency.

What is claimed is:

1. An outlet mechanism for producing a pulsating splash, the outlet mechanism comprising a main waterway including an inlet waterway, two branch waterways, outlet directions of outlet ends of the two branch waterways intersecting, the two branch waterways being communicated with an outlet end of the inlet waterway and arranged symmetrically with respect to the inlet waterway, two back-flow waterways being arranged symmetrically with respect to the inlet waterway, first ends of the two back-flow waterways being communicated with the two branch waterways and second ends of the two back-flow waterways being communicated with an inlet end of the inlet waterway, and two vortex cavities being arranged at a left side and a right side of the inlet waterway to enhance a flowing ability of fluid, the vortex cavities being arranged at the inlet waterway and near the outlet end of the inlet waterway, the vortex cavities being arranged in grooves at the left and right sides of the inlet waterway in a concaving manner, and the grooves being arranged to be globular, of which openings are smaller than a globular diameter at a portion away from the openings, the vortex cavities only having outlets at the openings so that fluid in the vortex cavities only leaves the vortex cavities directly into the inlet waterway and the branch waterways.

2. The outlet mechanism according to claim 1, wherein two side walls of the inlet waterway are arranged to be inclined planes with an included angle of 10 to 40 degrees.

3. The outlet mechanism according to claim 1, wherein each of the two branch waterways is divided by one of the two back-flow waterways into a first waterway and a second waterway, and the first waterway is designed to be a pliable waterway, wherein the first waterways of the two branch waterways are connected to left and the right sides of the outlet end of the inlet waterway, and the first waterways connect to the inlet waterway smoothly.

4. The outlet mechanism according to claim 3, wherein the outlet end of the inlet waterway between the two branch waterways is an arc groove.

5. The outlet mechanism according to claim 3, wherein an outlet area of the first waterways gradually increases, and the first ends of the back-flow waterways connect smoothly to the first waterways.

6. The outlet mechanism according to claim 3, wherein extended lines of the outlet ends of the two branch waterways are intersected to form a catchment segment, and an arc slot is arranged to a top end of the catchment segment.

7. The outlet mechanism according to claim 1, further comprising:

a body having an inlet hole and a concave cavity being arranged at the body; and an attaching wall, a water channel coupling with the main waterway being arranged at a side of the attaching wall, the attaching wall being mounted in the concave cavity of the body, and the side of the attaching wall being disposed on a side of the concave cavity hermetically, so that the main waterway is generated in the water channel, and the inlet waterway is communicated with the inlet hole.

8. The outlet mechanism according to claim 7, further comprising an outlet nozzle mounted to the concave cavity in a coupling manner, and outlet holes of the outlet nozzle are communicated with the outlet ends of the two branch waterways.

9. The outlet mechanism according to claim 1, further comprising:

a body, an inlet hole and a concave cavity being arranged at the body; and an attaching wall, a water channel coupling with the main waterway being arranged at a side of the attaching wall, the attaching wall being mounted in the concave cavity of the body, and the side of the attaching wall being disposed on a side of the concave cavity hermetically, so that the main waterway is generated in the water channel, and the inlet waterway is communicated with the inlet hole.

10. The outlet mechanism according to claim 2, further comprising a body, an inlet hole and a concave cavity being arranged at the body; and an attaching wall, a water channel coupling with the main waterway being arranged at a side of the attaching wall, the attaching wall being mounted in the concave cavity of the body, and the side of the attaching wall being disposed on a side of the concave cavity hermetically, so that the main waterway is generated in the water channel, and the inlet waterway is communicated with the inlet hole.

11. The outlet mechanism according to claim 9, further comprising an outlet nozzle mounted to the concave cavity of the body in a coupling manner, and outlet holes of the outlet nozzle are communicated with the outlet ends of the two branch waterways.

12. The outlet mechanism according to claim 10, further comprising an outlet nozzle mounted to the concave cavity of the body in a coupling manner, and outlet holes of the outlet nozzle are communicated with the outlet ends of the two branch waterways.

* * * * *